US005671548A

United States Patent [19]

Blaschka et al.

[11] Patent Number: 5,671,548

[45] Date of Patent: Sep. 30, 1997

[54] THREE ROW DRYING CYLINDER GROUP

[75] Inventors: Dieter Blaschka, Mochenwangen; Werner Leitenberger, Schlier-Wetzisreute; Andreas Merz, Ravensburg, all of Germany

[73] Assignee: Voith Sulzer Papiermaschinen GmbH, Germany

[21] Appl. No.: 662,705

[22] Filed: Jun. 13, 1996

[30] Foreign Application Priority Data

Jun. 30, 1995 [DE] Germany ..... 295 10 485 U

[51] Int. Cl.[6] ..... F26B 11/02

[52] U.S. Cl. ..... 34/117; 34/120

[58] Field of Search ..... 34/111, 113, 117, 34/118, 119, 120, 123

[56] References Cited

U.S. PATENT DOCUMENTS

| | | | |
|---|---|---|---|
| 4,481,723 | 11/1984 | Vedenpää | 34/117 X |
| 5,279,050 | 1/1994 | Törmänen | 34/117 |
| 5,537,755 | 7/1996 | Kotitschke | 34/117 |
| 5,539,999 | 7/1996 | Kuhasalo | 34/117 X |
| 5,560,123 | 10/1996 | Eskelinen | 34/117 X |

FOREIGN PATENT DOCUMENTS

| | | |
|---|---|---|
| 6925023 | 6/1969 | Germany . |
| 3623971 | 1/1988 | Germany . |

OTHER PUBLICATIONS

German Search Report, dated 28 Sep. 1995.

*Primary Examiner*—John M. Sollecito
*Assistant Examiner*—Steve Gravini
*Attorney, Agent, or Firm*—Ostrolenk, Faber, Gerb & Soffen, LLP

[57] ABSTRACT

A three row drying cylinder group for a drying section of a paper machine or the like. The bottom cylinder row felt only passes through the bottom row. The top cylinder row felt passes from the top row, wraps the first middle row cylinder as a deflection element, passes over the next top row cylinder, and then is guided so that the opposite side of the top felt passes the next middle row cylinder and is guided back to the top row to alternate between the two ways of passing the middle row cylinders. Those middle row cylinders which are deflection elements may be heated or not and may deliver suction or vacuum to hold the web to the felt.

20 Claims, 2 Drawing Sheets

THREE ROW DRYING CYLINDER GROUP

BACKGROUND OF THE INVENTION

The present invention relates to a three row drying cylinder group for drying a traveling web, in particular a web of paper or board, and particularly relates to the paths of the dryer felts or wires in such a dryer group, In a three row dryer group, a bottom felt wraps around the bottom side of every lower row drying cylinder and also around the bottom side of every second or alternate drying cylinder of the middle row. A top felt wraps around the top side of every upper row drying cylinder and also around the other drying cylinders in the middle row. One disadvantage of this known arrangement is that two felt guide rolls are required between every two adjacent cylinders in the middle row, one guide roll each for the top felt and the bottom felt. The space required for this is only available if the operating width of the paper machine, and thus also the diameter of its guide rolls, is relatively small. On the other hand, modern paper machines have high operating speeds and/or large operating widths (and therefore large guide roll diameters) making it extremely difficult or impossible to use the known arrangement.

Another disadvantage of the known arrangement is that long unsupported paths or open draws of the web are present. This creates a danger of frequent tears of the web. In such a case, there is a danger of a paper jam since the broke can be removed only with difficulty due to the existing narrow places.

SUMMARY OF THE INVENTION

The object of the present invention is to provide a three row drying cylinder group which is suitable even for a relatively large operating width. Additional requirements may be that the unsupported paths or open draws of web should be as short as possible to reduce the danger of web tearing. Furthermore, it should be possible to remove broke as rapidly as possible.

The dryer group according to the invention avoids having the first one of the two endless felts, and preferably the bottom felt, pressing the web of paper not only against the cylinders of the lower row but also against some of the cylinders of the middle row. Instead only the other second one of the two felts, preferably the top felt, presses the paper web not only against the (for instance) top sides of the top cylinders but also against same side, e.g., the top side of at least one cylinder of the middle row. In the preferred design, the other or second (top) felt presses the felt directly against the top side of alternate, or every other, middle row dryer. Also, the second felt supports the web on the outside of the second felt as the second felt passes around the remaining or alternate middle row cylinders, which cylinders may or may not be heated and may or may not apply suction through the felt to the web.

This solution reduces the need for numerous felt guide rolls because only one of the felts, rather than both, reaches to the middle row. This arrangement provides more space than was previously available for the remaining felt guide rolls which are still necessary. Therefore, guide rolls of larger diameter than previously can be used. This permits the operating width of the paper machine to be greater than previously. Furthermore, there is the possibility for the second felt, preferably the top felt, to guide the paper web a considerable distance from the respective second, e.g., top row of cylinders to the first or bottom row, or vice versa. This avoids the extremely long unsupported paper paths or open draws that were previously necessary. The danger of tearing of the paper is thus reduced. The paper machine can thus be operated with a greater operating efficiency than previously.

As already mentioned, the second, e.g., top felt preferably presses the paper web directly also against a cylinder of the middle row which is located between two cylinders of the second, e.g., top row. This has the advantage that any broke which is still produced can drop more easily than previously from the upper region into the lower region of the dryer group of drying cylinders. From there, the broke can be relatively easily removed from the drying cylinder group.

The above described solution has additional advantage. It permits felt deflection elements to be arranged at the places of those cylinders of the middle row over which the first, e.g., bottom felt would previously have traveled. The deflection elements, as is known from single felt drying groups, conduct the second or top felt, together with the web of paper wrapped around the outside of the second felt, from one second or top row cylinder to the following second or top row cylinder.

Each deflection element can, as known, be developed as a heatable or a non-heatable drying cylinder or as a grooved or perforated roll which cooperates with an external or internal suction box in order to produce a vacuum in the grooves and/or holes for holding the web to the second felt wrapped around the deflection element.

Other objects and features of the invention are described with reference to the drawings.

BRIEF DESCRIPTION OF THE DRAWINGS

Each of FIGS. 1 and 2 is a diagrammatic side view of a respective three row drying cylinder group.

DESCRIPTION OF THE PREFERRED EMBODIMENTS

Figure 1:
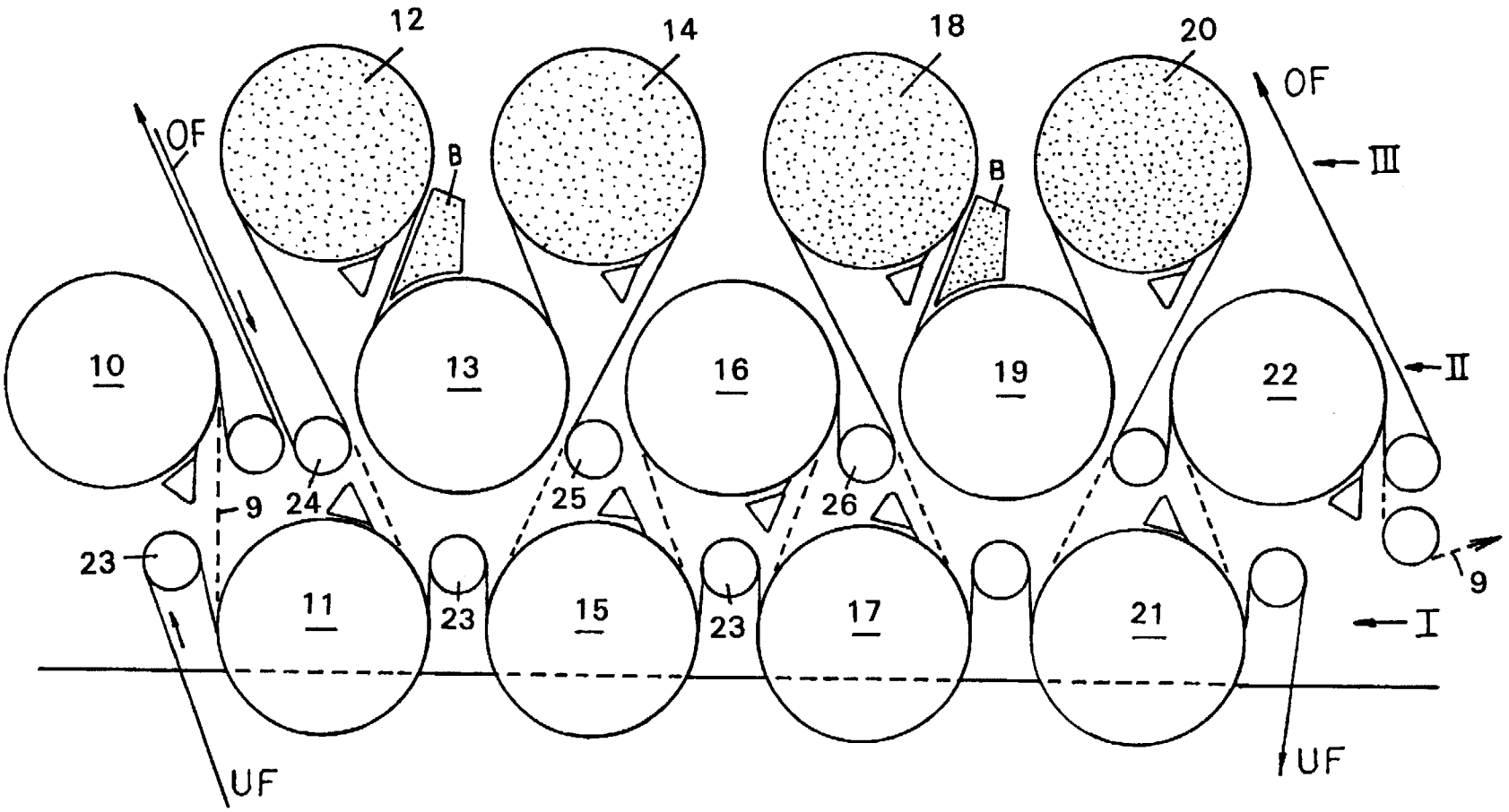

FIG. 1 shows one dryer group of a paper machine drying section that may include several dryer groups. The dryer group shown has three superimposed rows of drying cylinders, namely a bottom or lower row I, a middle row II with cylinder axes above the cylinder axes of the bottom row, and a top row III with cylinder axes above the cylinder axes of the middle row. The cylinders 11 to 22 together form a three row drying cylinder group in accordance with the invention. The cylinders 12, 14, 18 and 20 of the top cylinder row III lie substantially vertically above the cylinders 11, 15, 17 and 21 of the bottom cylinder row I. The cylinders 13, 16, 19 and 22 of the middle cylinder row II, on the other hand, are shifted horizontally from the other row cylinders and are each beneath the space between two cylinders of another row.

The web of paper travels in succession over the cylinders 10, 11 and 12–22. The cylinder 10 is the final cylinder of a preceding drying group, the remainder of which is not shown. Another group or other section of the machine may follow after the guide rolls following the cylinder 22.

A first, bottom, endless dryer felt or dryer wire UF travels alternately over guide rolls 23 and the cylinders 11, 15, 17 and 21 of the bottom row I. The rolls 23 guide the felt UF to partially wrap around the bottom sides of the bottom row cylinders against which the felt UF presses the web.

A second, top, endless dryer felt or dryer wire OF first travels over the entrance guide roll 24. At roll 24, the top felt takes up the paper web 9 to be dried from the previous dryer group and conducts the web over the cylinder 12, where the web comes into direct contact with the top of the cylinder 12 and the top felt covers over the web on that cylinder. The top felt then conducts the web around the middle row cylinder 13 with the web supported on the outside of the felt and from there the felt conducts the web to the next top row cylinder 14. The middle row cylinder 13 comes into direct contact with the upper felt with the web outside the felt, while the cylinder 14 comes into direct contact with the paper web with the felt outside the web. The top felt then conducts the paper web to a paper and felt guide roll 25 which is arranged relatively far down, between and slightly below the first two adjacent cylinders 13 and 16 of the middle row II. From the roll 25, the web of paper passes without support in an open draw to the bottom row cylinder 15 arranged below in the bottom row I. The web again travels without support from bottom row cylinder 15 to and around middle row cylinder 16 and then from cylinder 16 to bottom row cylinder 17 and then from cylinder 17 to the felt guide roll 26 in the middle row where the web is again picked up by the top felt. The top felt OF presses the paper web against the top of the middle row cylinder 16. Then, after passing the guide roll 26, the top felt conducts the web from the guide roll 26 to the following cylinder 18 of the top row III.

In the region of the further cylinders 19 to 22, the guidance of the web and felt which has already been described is repeated. In this arrangement, the web is in direct contact with alternate middle row drying cylinders 16 and 22, while the upper felt contacts the other middle row cylinders 13 and 19 with the web there outside the felt.

It is essential that all cylinders of the bottom row I and all cylinders of the top row III be developed as heatable drying cylinders. This applies also to the two cylinders 16 and 22 of the middle row II and any middle row cylinders that are directly contacted by the web. On the other hand, the cylinders 13 and 19 of the middle row II are as a rule not heated, since heating is not worthwhile for known reasons, e.g., they are directly contacted by the felts, not by the paper web.

As further shown in FIG. 1, web stabilizers B can be arranged in known manner at least at the cylinders 12 and 18 of the top row III and possibly also at the other cylinders 14 and 20 of the top row. These web stabilizers assure that the web of paper travels downward with the top felt OF.

Figure 2:
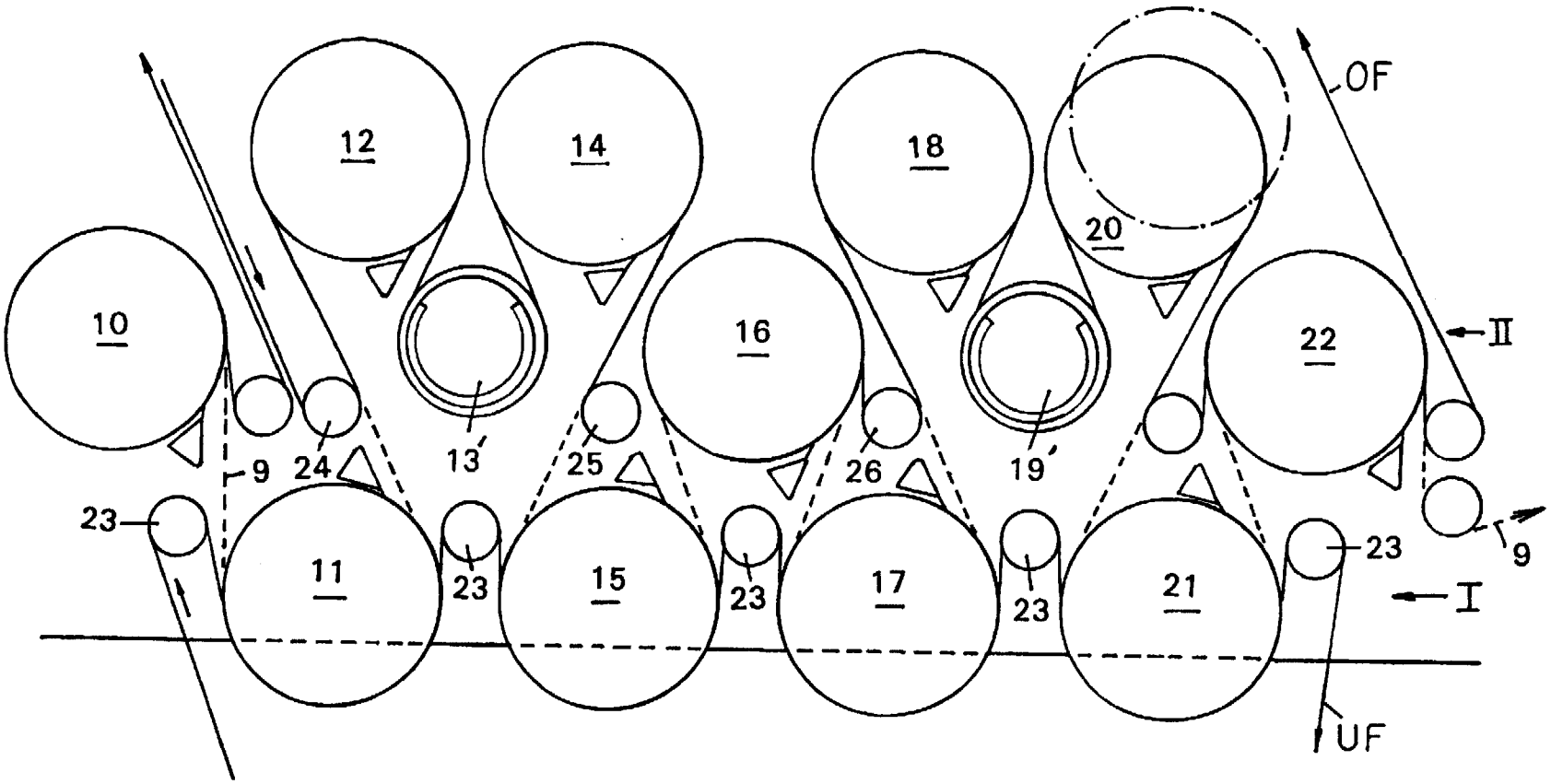

FIG. 2 differs from FIG. 1 substantially only by the fact that the two cylinders 13 and 19 of FIG. 1, which serve substantially only as deflection elements and are not heated, are replaced by suction guide rolls 13', 19' which are here shown Symbolically as suction rolls with internal stationary suction box. Since such suction rolls, like known suction rolls with external suction boxes, have a smaller diameter than drying cylinders, the structural height of the dryer group may be reduced. The supporting stands may be lower and thus have less tendency to vibrate. Furthermore, the web of paper is held fast reliably on the top felt against centrifugal force by the suction guide rolls 13' and 19' even at high operating speeds. In addition, if necessary, further known elements for stabilizing the web can be used, for instance, the web stabilizers B shown in FIG. 1. Similar devices of this type which fill the entire "pocket" defined between two adjacent cylinders in one row and a cylinder in the other row (for instance 12, 13 and 14) can be used in both embodiments. Furthermore, any types of known web holding boxes can be provided at the free web paths or open draws between the cylinder rows I and II.

Both FIGS. 1 and 2 show arrangements which are adapted to increase the drying capacity of an existing two row drying cylinder group through addition of an upper cylinder row III. However, they are suitable in exactly the same manner for installation in a new plant. A large number of cylinders are shown in rows I, II and III. Instead, there could also be three, five or six. The connection of two or three of the illustrated drying groups, one after the other, is also readily possible.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A three row drying cylinder group for the drying section of a paper or board or web making machine, the drying cylinder group comprising:

a top row of drying cylinders, a middle row of drying cylinders having axes below the axes of the top row of cylinders and a bottom row of drying cylinders having axes below the axes of the middle row of drying cylinders;

a bottom dryer felt, first guide means causing the bottom dryer felt to wrap around at least the bottom of each of the bottom row of drying cylinders for pressing a web against at least the bottoms of the bottom row of drying cylinders;

a top dryer felt, second guide means causing the top dryer felt to wrap around at least the top of each of the top row of drying cylinders for pressing the web against at least the tops of the top row of drying cylinders;

a first one of the top and bottom felts wraps the drying cylinders only in the respective first one of the top and bottom rows of drying cylinders without wrapping the drying cylinders in either of the other rows of drying cylinders;

the second one of the felts wraps all of the cylinders of the respective second one of the top and bottom rows of drying cylinders, and the respective guide means for the second felt guides the second felt to also wrap around at least one of the drying cylinders of the middle row of drying cylinders along the path of the second dryer felt from one of the drying cylinders in the second row of drying cylinders to the next adjacent drying cylinder in the second row of drying cylinders.

2. The drying cylinder group of claim 1, wherein the second felt has opposite first and second sides; the second felt first side wraps over one side of a first cylinder in the second row of drying cylinders, then the second felt second side wraps around a first one of the middle row of cylinders at the side of that cylinder away from the second row of drying cylinders, then the second felt first side wraps around the one side of a second cylinder in the second row of drying cylinders and the second cylinder in the second row of drying cylinders is adjacent the first cylinder in the second row of drying cylinders, then the second felt is guided toward the middle row of cylinders and is guided by the respective guide means so that the second felt first side wraps around the side of a second one of the middle row of cylinders that is toward the second row of drying cylinders, and then the second felt is guided back to a third cylinder in the second row of cylinders and the third cylinder in the second row of drying cylinders is adjacent the second cylinder in the second row of drying cylinders;

whereby the second felt second side wraps around the first one of the middle row of cylinders, with the web carried on the second felt first side along the outside of the first one of the middle row of cylinders, and then the second felt first side wraps the opposite side of the web directly on the second one of the middle row of cylinders as the web and the second felt wrap the second one of the middle row of cylinders.

3. A three row drying cylinder group for the drying section of a paper, or board or web making machine, the drying cylinder group comprising:

a top row of drying cylinders, a middle row of drying cylinders having axes below the axes of the top row of drying cylinders and a bottom row of drying cylinders having axes below the axes of the middle row of drying cylinders;

first felt guide rolls disposed between adjacent drying cylinders at a first one of the top and bottom rows of drying cylinders; a first drying section felt alternately partially wrapping around the outwardly facing side of each drying cylinder of the first one of the rows of drying cylinders, and then wrapping around the oppositely facing side of the adjacent first guide roll between two drying cylinders of the first row of drying cylinders and then wrapping the next adjacent drying cylinder in the first row of drying cylinders followed by the next adjacent first guide roll along the first row of drying cylinders;

second felt guide rolls between adjacent cylinders in the middle row of drying cylinders; a second drying section felt having first and second opposite sides, the second felt first side wrapping partially around the outwardly facing side of a first one of the drying cylinders in the second one of the top and bottom cylinder rows, so that the second felt first side faces toward a first one of the second row of drying cylinders, then the second felt partially wrapping around the side of a first one of the middle row of cylinders away from the second row of cylinders, with the second felt second side facing toward the first one of the middle row of cylinders, then the second felt passing around the outwardly facing side of a second one of the second row of cylinders with the second felt first side facing toward the second one of the second row of cylinders, then the second felt passing around a first one of the guide rolls between the first one of the middle row of cylinders and the adjacent second one of the middle row of cylinders, then the second felt partially wrapping the side of the second one of the middle row of cylinders toward the second row of cylinders, with the second felt first side facing toward the second one of the middle row of cylinders, then the second felt wrapping a second one of the guide rolls adjacent the second one of the middle row of cylinders and then the second felt being guided to wrap partially around the outwardly facing side of a third one of the second row of cylinders which is adjacent the second one of the second row of cylinders, with the second felt first side facing toward the third one of the second row of cylinders.

4. The drying cylinder group of claim 3, further comprising web directing means in the dryer group for directing the web along a web path, the path comprising directing the web to partially wrap around the first of the second row of drying cylinders so that the web is between the second felt and the first one of the second row of drying cylinders and so that the web is in direct contact with the first one of the second row of drying cylinders; for then directing the web to travel around the outside of the second felt wrapping around the first one of the middle row of cylinders; for then directing the web to travel between the second felt and the second one of the second row of cylinders; for then directing the web to wrap around a first one of the first row of cylinders with the web between the first felt and the first one of the first row cylinders; for then directing the web to the second one of the middle row of cylinders and the second felt wrapping partially around the second one of the middle row of cylinders with the web between the second felt and the second one of the middle row of cylinders; for then directing the web past the next adjacent, second one of the first row of cylinders and the first felt wrapping over the web around the second one of the first row of cylinders; then directing the web back to the second felt and together with the second felt back to the third one of the second row of cylinders which is adjacent the second one of the second row cylinders, whereby the second side of the web faces toward the first one of the middle row of cylinders but is separated from that cylinder by the second felt, while the first side of the web is in contact with the second one of the middle row of cylinders.

5. The drying cylinder group of claim 4, wherein the web directing means directs the web along a pathway through the drying group which repeats the web path past the cylinders of the dryer group.

6. The drying cylinder group of claim 4, wherein the first one of the middle row of cylinders is in direct contact with the second felt and in indirect contact with the web, and the first middle row cylinder comprises a web and felt deflection element.

7. The drying cylinder group of claim 6, wherein the deflection element is heated.

8. The drying cylinder group of claim 6, wherein the deflection element is not heated.

9. The drying cylinder group of claim 6, wherein the deflection element comprises a roll having an outer surface with recesses for being acted upon by vacuum applied to the recesses.

10. The drying cylinder group of claim 6, wherein the deflection element comprises a suction roll.

11. The drying cylinder group of claim 4, wherein the first row of drying cylinders is the bottom row and the second row of drying cylinders is the top row, the first felt is the bottom felt and the second felt is the top felt.

12. The drying cylinder group of claim 3, wherein the first row of drying cylinders is the bottom row and the second row of drying cylinders is the top row, the first felt is the bottom felt and the second felt is the top felt.

13. A three row drying cylinder group for the drying section of a paper, or board or web making machine, the drying cylinder group comprising:

a top row of drying cylinders, a middle row of drying cylinders having axes below the axes of the top row of cylinders and a bottom row of drying cylinders having axes below the axes of the middle row of drying cylinders;

a first drying section felt partially wrapping around the outwardly facing side of each drying cylinder of a first one of the top and bottom rows of drying cylinders; first felt guide means in the first row of drying cylinders for guiding the first felt to partially wrap around the outwardly facing side of each one of the first row of cylinders;

a second drying section felt having first and second opposite sides;

second felt guide means for guiding the second felt to partially wrap over the outwardly facing side of a first cylinder of a second one of the top and bottom rows of drying cylinders; then guiding the second felt to pass around the side of a first one of the middle row of cylinders that faces away from the second row of cylinders; then guiding the second felt to wrap around the outwardly facing side of a second cylinder of the second row of cylinders adjacent the first cylinder of the second row; then guiding the second felt to wrap around a second one of the middle row of cylinders that is adjacent to the first one of the middle row of cylinders, and to wrap around the side of the second one of the middle row of cylinders that faces toward the second row cylinders; then guiding the second felt further through the drying group;

whereby the first side of the second felt wraps the first one of the middle row of cylinders and the second side of the second felt wraps the second one of the middle row of cylinders, while the second side of the second felt also wraps the first and second ones of the second row of cylinders.

14. The drying cylinder group of claim 13, further comprising a third one of the second row of cylinders adjacent to the second one of the second row of cylinders; the second felt guide means guiding the second felt to wrap around the outwardly facing side of the third one of the second row of cylinders;

a third one of the middle row of cylinders, adjacent to the second one of the middle row of cylinders, and the second felt wrapping around the side of the third one of the middle row of cylinders that faces away from the second row of cylinders.

15. The drying cylinder group of claim 14, wherein the second felt guide means comprises a first felt guide roll between the first and second ones of the middle row of cylinders and a second felt guide roll between the second and third ones of the middle row of cylinders; the first and second felt guide rolls being placed so as to guide the second felt to move from the second one of the second row of cylinders, wrapping around the first felt guide roll to then wrap the second one of the middle row of cylinders, wrapping around the second felt guide roll and to then to wrap around the third one of the second row of cylinders.

16. The drying cylinder group of claim 13, wherein the second felt guide means comprises a first felt guide roll between the first and second ones of the middle row of cylinders and a second felt guide roll at the side of the second one of the middle row of cylinders which is outside the space between the first and second ones of the middle row of cylinders;

wherein the first and second felt rolls guide the second felt to move off the second one of the second row of cylinders, toward the middle row of cylinders, to wrap the first felt guide roll, and to then wrap the second one of the middle row of cylinders, and then to wrap the second felt guide roll, wherein the first and second felt guide rolls direct the second felt to wrap the second one of the middle row of cylinders.

17. The drying cylinder group of claim 16, wherein the first row of cylinders is the bottom row and the second row of cylinders is the top row thereof.

18. The drying cylinder group of claim 16, wherein the first guide means for the first felt comprises a respective felt guide roll between each of the adjacent drying cylinders in the first row of drying cylinders, the felt guide rolls of the first row being so placed as to cause the first felt to wrap over the sides of the first cylinder facing outward from the dryer group.

19. The drying cylinder group of claim 13, wherein the first row of cylinders is the bottom row and the second row of cylinders is the top row thereof.

20. The drying cylinder group of claim 13, wherein the first guide means for the first felt comprises a respective felt guide roll between each of the adjacent drying cylinders in the first row of drying cylinders, the felt guide rolls of the first row being so placed as to cause the first felt to wrap over the sides of the first cylinder facing outward from the dryer group.

* * * * *